US011112713B2

(12) United States Patent
Akiyama et al.

(10) Patent No.: US 11,112,713 B2
(45) Date of Patent: Sep. 7, 2021

(54) TONER

(71) Applicant: CANON KABUSHIKI KAISHA, Tokyo (JP)

(72) Inventors: Hiroki Akiyama, Suntou-gun (JP); Shuhei Moribe, Mishima (JP); Hiroyuki Tomono, Numazu (JP); Tatsuya Saeki, Suntou-gun (JP); Hiroki Kagawa, Mishima (JP); Atsuhiko Ohmori, Yokohama (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/802,814

(22) Filed: Feb. 27, 2020

(65) Prior Publication Data

US 2020/0285164 A1 Sep. 10, 2020

(30) Foreign Application Priority Data

Mar. 8, 2019 (JP) ..... JP2019-042839

(51) Int. Cl.
*G03G 9/087* (2006.01)

(52) U.S. Cl.
CPC ..... *G03G 9/08797* (2013.01); *G03G 9/08755* (2013.01); *G03G 9/08777* (2013.01)

(58) Field of Classification Search
None
See application file for complete search history.

(56) References Cited

U.S. PATENT DOCUMENTS

| | | | |
|---|---|---|---|
| 6,875,549 | B2 | 4/2005 | Yamazaki et al. |
| 6,881,527 | B2 | 4/2005 | Moribe et al. |
| 7,267,919 | B2 | 9/2007 | Moribe et al. |
| 7,273,686 | B2 | 9/2007 | Onuma et al. |
| 7,288,354 | B2 | 10/2007 | Moribe et al. |
| 7,351,509 | B2 | 4/2008 | Moribe et al. |
| 7,422,832 | B2 | 9/2008 | Ogawa et al. |
| 7,537,877 | B2 | 5/2009 | Yoshiba et al. |
| 7,544,455 | B2 | 6/2009 | Yoshiba et al. |
| 7,638,251 | B2 | 12/2009 | Yamazaki et al. |
| 7,700,254 | B2 | 4/2010 | Moribe et al. |
| 7,740,998 | B2 | 6/2010 | Yamazaki et al. |
| 7,855,042 | B2 | 12/2010 | Kobori et al. |
| 7,897,316 | B2 | 3/2011 | Yamazaki et al. |
| 8,026,030 | B2 | 9/2011 | Moribe et al. |
| 8,057,977 | B2 | 11/2011 | Moribe et al. |
| 8,501,377 | B2 | 8/2013 | Takahashi et al. |
| 8,512,925 | B2 | 8/2013 | Moribe et al. |
| 8,614,044 | B2 | 12/2013 | Matsui et al. |
| 8,883,389 | B2 | 11/2014 | Matsui et al. |
| 9,040,216 | B2 | 5/2015 | Fukudome et al. |
| 9,097,998 | B2 | 8/2015 | Yamazaki et al. |
| 9,116,448 | B2 | 8/2015 | Terauchi et al. |
| 9,128,400 | B2 | 9/2015 | Takahashi et al. |
| 9,134,637 | B2 | 9/2015 | Hotta et al. |
| 9,141,012 | B2 | 9/2015 | Moribe et al. |
| 9,152,065 | B2 | 10/2015 | Sano et al. |
| 9,201,323 | B2 | 12/2015 | Nishikawa et al. |
| 9,213,250 | B2 | 12/2015 | Nomura et al. |
| 9,213,251 | B2 | 12/2015 | Ohmori et al. |
| 9,239,528 | B2 | 1/2016 | Hasegawa et al. |
| 9,250,548 | B2 | 2/2016 | Nomura et al. |
| 9,261,804 | B2 | 2/2016 | Yamazaki et al. |
| 9,261,806 | B2 | 2/2016 | Moribe et al. |
| 9,285,697 | B2 | 3/2016 | Fukudome et al. |
| 9,304,422 | B2 | 4/2016 | Matsui et al. |
| 9,341,970 | B2 | 5/2016 | Yoshiba et al. |
| 9,348,246 | B2 | 5/2016 | Magome et al. |
| 9,354,545 | B2 | 5/2016 | Matsui et al. |
| 9,442,416 | B2 | 9/2016 | Magome et al. |
| 9,448,501 | B2 | 9/2016 | Inoue et al. |
| 9,470,993 | B2 | 10/2016 | Nishikawa et al. |
| 9,575,425 | B2 | 2/2017 | Naka et al. |
| 9,588,450 | B2 | 3/2017 | Tsuda et al. |
| 9,606,462 | B2 | 3/2017 | Nomura et al. |
| 9,715,188 | B2 | 7/2017 | Terauchi et al. |
| 9,772,570 | B2 | 9/2017 | Tsuda et al. |
| 9,829,818 | B2 | 11/2017 | Yoshiba et al. |
| 9,964,874 | B2 | 5/2018 | Suzumura et al. |
| 9,971,263 | B2 | 5/2018 | Fukudome et al. |
| 10,101,683 | B2 | 10/2018 | Nishikawa et al. |

(Continued)

FOREIGN PATENT DOCUMENTS

| | | |
|---|---|---|
| JP | 2004-191927 | 7/2004 |
| JP | 2013-200559 | 10/2013 |
| JP | 2014-172955 | 9/2014 |

*Primary Examiner* — Christopher D Rodee
(74) *Attorney, Agent, or Firm* — Venable LLP

(57) ABSTRACT

A toner including a toner particle containing a binder resin, wherein the binder resin contains a crystalline resin, and in viscoelasticity measurement of the toner with Tp being a peak temperature of an endothermic peak derived from the crystalline resin in DSC of the toner, given G'(Tp−5, 0.01 Hz) as a storage modulus at a temperature of Tp−5° C. and a frequency of 0.01 Hz, G'(Tp−5, 10 Hz) as a storage modulus at a temperature of Tp−5° C. and a frequency of 10 Hz, and G'(Tp−30, 10 Hz) as a storage modulus at a temperature of Tp−30° C. and a frequency of 10 Hz, the following formulae are satisfied:

$$G'(Tp-30,10\text{ Hz})/G'(Tp-5,0.01\text{ Hz})\leq 1.40$$

$$G'(Tp-5,10\text{ Hz})/G'(Tp-5,0.01\text{ Hz})\leq 2.20.$$

7 Claims, No Drawings

(56) References Cited

U.S. PATENT DOCUMENTS

| | | | | |
|---|---|---|---|---|
| 10,241,430 | B2 | 3/2019 | Kimura et al. | |
| 10,289,016 | B2 | 5/2019 | Fukudome et al. | |
| 10,295,921 | B2 | 5/2019 | Ohmori et al. | |
| 2004/0110076 | A1 | 6/2004 | Yamazaki et al. | |
| 2004/0229149 | A1* | 11/2004 | Kadota | G03G 9/0821 430/111.4 |
| 2011/0065039 | A1* | 3/2011 | Ota | G03G 9/08766 430/109.3 |
| 2011/0116841 | A1* | 5/2011 | Park | G03G 9/08795 399/252 |
| 2013/0101932 | A1* | 4/2013 | Yamauchi | G03G 9/08777 430/105 |
| 2013/0252167 | A1 | 9/2013 | Moribe et al. | |
| 2013/0309603 | A1 | 11/2013 | Takahashi et al. | |
| 2014/0302437 | A1* | 10/2014 | Shimano | G03G 9/08711 430/137.15 |
| 2015/0125790 | A1 | 5/2015 | Hotta et al. | |
| 2015/0185658 | A1 | 7/2015 | Wakabayashi et al. | |
| 2016/0161874 | A1 | 6/2016 | Yamazaki et al. | |
| 2017/0336726 | A1* | 11/2017 | Hasegawa | G03G 9/08782 |
| 2019/0250526 | A1 | 8/2019 | Watanabe et al. | |
| 2019/0250528 | A1 | 8/2019 | Watanabe et al. | |
| 2019/0384192 | A1 | 12/2019 | Kagawa et al. | |
| 2019/0384195 | A1 | 12/2019 | Saeki et al. | |
| 2020/0081361 | A1 | 3/2020 | Yoshiba et al. | |

* cited by examiner

TONER

BACKGROUND OF THE INVENTION

Field of the Invention

The present invention relates to a toner used in, for example, electrophotographic methods, electrostatic recording methods, and magnetic recording methods.

Description of the Related Art

In recent years, energy savings have become a major technical issue in the field of electrophotographic devices, and reductions in the amount of heat applied to the fixing apparatus are desired. Furthermore, high speed printing is also in increased demand in order to increase productivity. To address these issues, there is increased need for so called "low-temperature fixability", which allows toner to be fixed with less energy.

In addition, there has been a growing demand for very high image quality, with applications covering commercial printing taken into consideration.

To achieve low-temperature fixability, toners have been developed that use crystalline resins having the "sharp melt property" of softening abruptly at the melting point in the toner binder resin.

For example, an example of a toner using a crystalline polyester as a crystalline resin is described in Japanese Patent Application Publication No. 2004-191927.

SUMMARY OF THE INVENTION

Although toners using crystalline resins have improved fixing performance, fixing irregularities caused by pressure during fixing can occur during high-speed printing due to the fragility of the crystalline resin. In systems that use large quantities of crystalline resin with the aim of further improving low-temperature fixability, moreover, the irregular crystal states of the crystalline resin cannot be ignored. It has been found that this causes the melting point of the crystalline resin to deviate and the endothermic quantity to differ among toner particles, causing fixing irregularities.

Meanwhile, Japanese Patent Application Publication No. 2013-200559 discloses an example that uses a carbonate filler in a crystalline resin to ameliorate the fragility of the crystalline resin by means of a filler effect. However, it has been found that this does not improve the crystalline states, and is not sufficient to improve fixing irregularity.

That is, to achieve better low-temperature fixability while improving fixing irregularity in a toner using a crystalline resin, it is necessary to increase the strength of the crystalline resin while also achieving more uniform crystal states.

The present invention, which was developed in light of these circumstances, provides a toner whereby high-quality images can be obtained by improving low-temperature fixability and suppressing fixing irregularities during high-speed printing with a toner containing a crystalline resin.

The present invention relates to a toner comprising:

a toner particle containing a binder resin, wherein the binder resin contains a crystalline resin, an endothermic peak derived from the crystalline resin exists in a temperature-endothermic quantity curve obtained by differential scanning calorimetry of the toner, and in viscoelasticity measurement of the toner with Tp being a peak temperature of the endothermic peak derived from the crystalline resin, given G'(Tp−5, 0.01 Hz) as a storage modulus at a temperature of Tp−5° C. and a frequency of 0.01 Hz, G'(Tp−5, 10 Hz) as a storage modulus at a temperature of Tp−5° C. and a frequency of 10 Hz, and G'(Tp−30, 10 Hz) as a storage modulus at a temperature of Tp−30° C. and a frequency of 10 Hz, formulae below are satisfied:

$$G'(Tp-30,10\text{ Hz})/G'(Tp-5,0.01\text{ Hz})\leq 1.40$$

$$G'(Tp-5,10\text{ Hz})/G'(Tp-5,0.01\text{ Hz})\leq 2.20.$$

The present invention can provide a toner whereby fixing irregularities can be ameliorated while maintaining low-temperature fixability with a toner using a crystalline resin.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" in the present invention include the numbers at the upper and lower limits of the range.

The present invention relates to a toner comprising:

a toner particle containing a binder resin, wherein the binder resin contains a crystalline resin, an endothermic peak derived from the crystalline resin exists in a temperature-endothermic quantity curve obtained by differential scanning calorimetry of the toner, and in viscoelasticity measurement of the toner with Tp being a peak temperature of the endothermic peak derived from the crystalline resin, given G'(Tp−5, 0.01 Hz) as a storage modulus at a temperature of Tp−5° C. and a frequency of 0.01 Hz, G'(Tp−5, 10 Hz) as a storage modulus at a temperature of Tp−5° C. and a frequency of 10 Hz, and G'(Tp−30, 10 Hz) as a storage modulus at a temperature of Tp−30° C. and a frequency of 10 Hz, formulae below are satisfied:

$$G'(Tp-30,10\text{ Hz})/G'(Tp-5,0.01\text{ Hz})\leq 1.40$$

$$G'(Tp-5,10\text{ Hz})/G'(Tp-5,0.01\text{ Hz})\leq 2.20.$$

Using the toner of the present invention, it is possible to improve low-temperature fixability while also ameliorating fixing irregularities during high-speed printing with a toner containing a crystalline resin to thereby obtain high-quality images.

As discussed above, crystalline resins are not only highly sensitive to temperature because of their sharp melt property, but also highly sensitive to pressure due to their fragility. Immediately before the melting point, these properties also combine to further increase the pressure sensitivity. Due to the effect of surface irregularities, the toner present on raised parts of the paper is subjected to greater heat and pressure during fixing on paper or the like, which causes the toner present on the raised parts to be melted excessively. As a result, the graininess of the toner disappears and it becomes smooth, making raised parts appear as high gloss parts.

Meanwhile, because the toner present in the indentations is subjected to less pressure during fixing, these toner particles do not melt completely and remain grainy. Thus, the indentations become low gloss parts, resulting in fixing irregularities. Such fixing irregularities are less evident during low-speed printing because sufficient heat is received from the fixing unit, but during high-speed printing fixing irregularities occur because sufficient heat is not received to completely melt the toner particles.

The inventors discovered as a result of exhaustive research that these problems could be solved by controlling the storage modulus of the toner within a specific range in a toner using a crystalline resin. The details are described below.

By controlling the storage modulus within a specific range, it is possible to reduce pressure-dependency immediately before the melting point, thereby preventing excessive melting of the toner and suppressing fixing irregularity.

Specifically, a toner has an endothermic peak derived from a crystalline resin in a temperature-endothermic quantity curve obtained by differential scanning calorimetry (DSC) of the toner, and in viscoelasticity measurement of the toner with Tp being the peak temperature of the endothermic peak derived from the crystalline resin, it is important that given G'(Tp−5, 0.01 Hz) as a storage modulus at a temperature of Tp−5° C. and a frequency of 0.01 Hz and G'(Tp−30, 10 Hz) as a storage modulus at a temperature of Tp−30° C. and a frequency of 10 Hz, G'(Tp−30, 10 Hz)/G'(Tp−5, 0.01 Hz)≤1.40 is satisfied.

G'(Tp−30, 10 Hz) represents the storage modulus when no heat is applied. The frequency of 10 Hz is a high frequency, and corresponds to the behavior when the amount of toner deformation is small. On the other hand, G'(Tp−5, 0.01 Hz) represents low-frequency displacement in an easily deformed state immediately before the melting point, or in other words a state in which the toner is greatly deformed.

When the ratio G'(Tp−30, 10 Hz)/G'(Tp−5, 0.01 Hz) is small, this means that there is little difference in the amount of deformation between the low-temperature, low-deformation state and the high-temperature, high-deformation state. This shows that there is no toner deformation until just before the melting point, and the toner is resistant to the effects of temperature and pressure irregularities. If G'(Tp−30, 10 Hz)/G(Tp−5, 0.01 Hz) exceeds 1.40, the toner is more likely to be affected by temperature and pressure irregularities on the paper, causing fixing irregularities to occur on the image after fixing.

The ratio is more preferably not more than 1.30. There is no particular lower limit, but preferably it is at least 1.00, or more preferably at least 1.10.

The Tp is preferably from 50° C. to 150° C., or more preferably from 55° C. to 90° C.

It is also important that given G'(Tp−5, 10 Hz) as the storage modulus at a temperature of Tp−5° C. and a frequency of 10 Hz, G'(Tp−5, 10 Hz)/G'(Tp−5, 0.01 Hz)≤2.20 is satisfied.

The inventors discovered as a result of further research that the value of G'(Tp−5, 10 Hz)/G'(Tp−5, 0.01 Hz) is smaller the greater the amount of the crystalline resin and degree of crystallization of the crystalline resin. On the other hand, the ratio was also found to rise as the proportion of amorphous resin increases. In particular, the value becomes larger when Tp−5° C. exceeds the glass transition temperature Tg of the amorphous resin contained in the toner particle and the amorphous part of the crystalline resin.

This is thought to be because in a somewhat overheated state at Tp−5° C., pressure dependency increases because the amorphous resin is in a glass state or a heated state with reduced viscosity. For these reasons, G'(Tp−5, 10 Hz)/G'(Tp−5, 0.01 Hz) correlates with fixing performance, and fixing performance declines as the value rises.

G'(Tp−5, 10 Hz)/G'(Tp−5, 0.01 Hz) is preferably not more than 2.00, or more preferably not more than 1.90. There is no particular lower limit, but preferably it is at least 1.00, or more preferably at least 1.30.

G'(Tp−5, 0.01 Hz) here is preferably from $1.0\times10^7$ Pa to $1.0\times10^8$ Pa. Within this range, it is easier to achieve both toner strength and low-temperature fixability.

Out of the above properties, it is desirable to include a filler in the toner particle in order to obtain G'(Tp−30, 10 Hz)/G'(Tp−5, 0.01 Hz)≤1.40. The filler used is not particularly limited as long as the storage modulus of the filler can satisfy conditions described above, and may be selected appropriately according to the object.

Examples include organic fillers and inorganic fillers. Examples of organic fillers include cellulose fillers, polylactic acid fillers, lignin fillers and the like. Examples of inorganic fillers include silica fillers, magnetic fillers and the like.

G'(Tp−30, 10 Hz)/G'(Tp−5, 0.01 Hz) can be controlled by controlling the type of filler and the like.

Moreover, in viscoelasticity measurement of the filler, given GF'(Tp−30, 10 Hz) as the storage modulus at a temperature of Tp−30° C. and a frequency of 10 Hz and GF'(Tp−5, 0.01 Hz) as the storage modulus at a temperature of Tp−5° C. and a frequency of 0.01 Hz, it is preferably to satisfy 0.70 GF'(Tp−30, 10 Hz)/GF'(Tp−5, 0.01 Hz)≤1.30.

More preferably, 0.90 GF'(Tp−30, 10 Hz)/GF'(Tp−5, 0.01 Hz)≤1.20 is satisfied.

If the above formulae are satisfied, this means that there is little change in the storage modulus of the filler in the range of Tp−30° C. to Tp−5° C. Changes in the storage modulus of the crystalline resin are reduced when such a material is included in addition to the crystalline resin. In other words, G'(Tp−30, 10 Hz)/G' Tp−5, 0.01 Hz) is reduced.

The value of GF'(Tp−30, 10 Hz)/GF'(Tp−5, 0.01 Hz) can be controlled by controlling the content of the filler.

The filler preferably has crystallinity. If the filler has crystallinity it interacts with the crystals of the crystalline resin, increasing the degree of crystallinity of the crystalline resin. It is thus possible to suppress fixing irregularity by making the melting point and endothermic quantity of the crystalline resin more uniform from toner particle to toner particle.

X-ray diffraction measurement can be used to determine whether or not the filler is crystalline.

The content of the filler in the toner is preferably from 0.5 mass % to 50 mass %, or more preferably from 0.5 mass % to 30 mass %. If this content is at least 0.5 mass %, the effect on the storage modulus is sufficient, while if it is not more than 50 mass % low-temperature fixability is improved.

The mass ratio of the filler content to the crystalline resin content (filler/crystalline resin) is preferably 1/200 to 1/1, or more preferably 1/100 to 1/3.

The filler also preferably has a cellulose structure. The filler more preferably contains cellulose powder, and still more preferably is cellulose powder. Cellulose has a diffraction peak at a position near those of the crystalline resins commonly used in toners. That is, the crystallinity of the crystalline resin can be further increased because the cellulose and crystalline resin have similar crystal lattice spacing. Fixing irregularity can thus be suppressed. A commercial cellulose powder may be used, such as Avicel PH-101 cellulose filler (Sigma-Aldrich) or the like.

The filler preferably contains a lignin/cellulose complex, and more preferably is a lignin/cellulose complex. Thermal conductivity is increased and low-temperature fixability is improved by further including lignin. This effect is greater if these are included in a complex state rather than individually. The lignin/cellulose complex can be obtained as an intermediate in the production of pulp from wood. Plant material is mechanically and/or chemically treated to break the chemical bonds in the plant material and remove hemicellulose, and a lignin/cellulose complex comprised of lignin chemically bonded with cellulose is extracted.

In the lignin/cellulose complex, an absorption band of ether bonds indicating bonding between lignin and cellulose is preferably confirmed near 1240 $cm^{-1}$ to 1220 $cm^{-1}$ in FT-IR analysis.

A lignin/cellulose complex can be obtained for example by the methods described in Japanese Patent Application Publication No. 2014-172955. Specifically, bamboo or other wood material can be heat treated using superheated steam at preferably 170° C. to 250° C., and then pulverized to the desired major axis diameter distribution to obtain a superheated steam-treated bamboo powder containing a lignin/cellulose complex. A commercial product may also be used, such as superheated steam-treated bamboo powder from Bamboo Techno for example.

The filler is preferably enveloped in the toner. For this reason, the long diameter of the filler is preferably not more than 10 μm. When using a commercial filler, a crusher or classifier can be used separately to adjust the particle size. There is no particular lower limit to the filler diameter, and a nanometer-sized filler such as cellulose nanofiber may be used for example.

The weight-average particle diameter (D4) of the toner is preferably from 4.0 μm to 12.0 μm, or more preferably from 5.0 μm to 10.0 μm.

The average major axis diameter of the filler is preferably from 5 nm to 10 μm, or more preferably from 0.5 μm to 4 μm.

To obtain G(Tp−5, 10 Hz)/G'(Tp−5, 0.01 Hz)≤2.20 out of the physical properties described above, the endothermic quantity of the endothermic peak derived from the crystalline resin in the toner is preferably from 20 J/g to 200 J/g, or more preferably from 40 J/g to 200 J/g. Within this range, good low-temperature fixability can be obtained.

The toner particle contains a crystalline resin as a binder resin. The crystalline resin is described below.

In the present invention, any resin that has crystallinity and a storage modulus that fulfills the above conditions may be selected appropriately as the crystalline resin, without any particular restriction. A resin may be one having a peak molecular weight (Mp) of 1000 or more for example.

The crystalline resin exhibits a melting endothermic peak (melting point) in differential scanning calorimetry using a differential scanning calorimeter (DSC).

Crystalline resins that can be used include for example crystalline polyester resins, crystalline ester compounds, crystalline polyurethane resins, crystalline polyurea resins, crystalline polyamide resins, crystalline polyether resins, crystalline vinyl resins, and modified crystalline resins of these. A crystalline polyester resin or urethane denatured crystalline polyester resin or a hybrid resin of a crystalline polyester resin and a vinyl resin is preferred. One kind may be used alone, or two or more kinds may be combined.

When using two or more kinds, the Tp is the melting point of the endothermic peak observed at the lower temperature. In particular, the crystalline resin preferably contains a crystalline polyester resin from the standpoint of melting point and mechanical strength. The content of the crystalline polyester in the crystalline resin is preferably 20 mass % to 100 mass %.

The crystalline polyester resin is not particularly limited, and examples include those obtained by condensation polymerization of diol components and dicarboxylic acid components.

The diol component can be specifically exemplified by the following:

ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, 2-methyl-1,3-propanediol, cyclohexanediol, cyclohexanedimethanol, and derivatives of the preceding. The derivative should provide the same resin structure by the aforementioned condensation polymerization, but is not otherwise particularly limited. An example here is a derivative in which the diol is esterified.

Among the preceding, linear aliphatic diols having from 4 to 10 carbons are preferred from the standpoint of the melting point and an ester group concentration.

Trihydric and higher hydric alcohols may also be used, e.g., glycerol, pentaerythritol, hexamethylolmelamine, and hexaethylolmelamine.

The dicarboxylic acid component can be specifically exemplified by the following:

oxalic acid, malonic acid, maleic acid, fumaric acid, citraconic acid, itaconic acid, glutaconic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; alicyclic dicarboxylic acids such as 1,1-cyclopentenedicarboxylic acid, 1,4-cyclohexanedicarboxylic acid, 1,3-cyclohexanedicarboxylic acid, and 1,3-adamantanedicarboxylic acid; aromatic dicarboxylic acids such as phthalic acid, isophthalic acid, terephthalic acid, p-phenylenediacetic acid, m-phenylenediacetic acid, p-phenylenedipropionic acid, m-phenylenedipropionic acid, naphthalene-1,4-dicarboxylic acid, and naphthalene-1,5-dicarboxylic acid; and derivatives of the preceding. The derivative should provide the same resin structure by the aforementioned condensation polymerization, but is not otherwise particularly limited. Examples here are derivatives provided by the methyl esterification or ethyl esterification of the dicarboxylic acid and derivatives provided by conversion of the dicarboxylic acid into the acid chloride.

In addition, a tribasic or higher basic polybasic carboxylic acid may also be used, such as trimellitic acid, pyromellitic acid, naphthalenetricarboxylic acid, naphthalenetetracarboxylic acid, pyrenetricarboxylic acid, and pyrenetetracarboxylic acid.

A crystalline ester compound may also be used as the crystalline resin. Examples include ester compounds of polyvalent carboxylic acids with aliphatic monoalcohols, and ester compounds of polyhydric alcohols with aliphatic monocarboxylic acids. Preferred examples include ester compounds of at least one polyhydric alcohol selected from the group consisting of pentaerythritol and dipentaerythritol with at least one aliphatic monocarboxylic acid selected from the group consisting of the $C_{10-22}$ linear aliphatic monocarboxylic acids. An ester compound of dipentaerythritol with palmitic acid is more preferred.

From the standpoint of low-temperature fixability and heat resistance, the melting point of the crystalline resin is preferably from 50° C. to 150° C. If it is at least 50° C. heat resistance is good, while if it is not more than 150° C. low-temperature fixability is good.

The peak molecular weight (Mp) of the crystalline resin is preferably from 1000 to 100000. If it is at least 1000 the above physical properties can be easily achieved, while if it is not more than 100000 the toner is easy to manufacture.

The storage modulus of the crystalline resin at Tp−30° C., 10 Hz is preferably from $1.00\times10^7$ Pa to $1.00\times10^9$ Pa. If it is at least $1.00\times10^7$ Pa fixing irregularities are suppressed, while if it is not more than $1.00\times10^9$ Pa good low-temperature fixability is obtained.

The toner particle may also contain a binder resin that is not crystalline.

Examples of binder resins include polyester resins, vinyl resins, epoxy resins and polyurethane resins, and a conventional known resin may be used without any particular limitations. A polyester resin or vinyl resin or a hybrid resin of these is preferred.

The content of the crystalline resin in the binder resin is preferably 20 mass % to 100 mass %, or more preferably 25 mass % to 100 mass %, or still more preferably 35 mass % to 100 mass %.

The toner particle may also contain a magnetic material or colorant.

Examples of magnetic materials include iron oxides such as magnetite, hematite and ferrite, metals such as iron, cobalt and nickel or alloys of these metals with other metals such as aluminum, cobalt, copper, lead, magnesium, tin, zinc, antimony, bismuth, calcium, manganese, titanium, tungsten and vanadium, and mixtures of these.

The content of the magnetic material is preferably 10 mass parts to 200 mass parts, or more preferably 20 mass parts to 150 mass parts per 100 mass parts of the binder resin.

Examples of colorants include the following.

Carbon black, grafted carbon, and blacks prepared by blending the yellow, magenta and cyan colorants described below may be used as black colorants.

Examples of yellow colorants include compounds such as condensed azo compounds, isoindolinone compounds, anthraquinone compounds, azo metal complexes, methine compounds and allylamide compounds.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, perylene compounds and the like.

Examples of cyan colorants include copper phthalocyanine compounds and their derivatives, anthraquinone compounds, and basic dye lake compounds and the like. These compounds may be used individually, or as a mixture, or in the form of a solid solution.

The content of the colorant is preferably 3.0 mass parts to 15.0 mass parts per 100.0 mass parts of the binder resin.

The toner particle may also contain a wax in addition to the crystalline resin.

Examples of waxes include the following: aliphatic hydrocarbon waxes such as low-molecular-weight polyethylene, low-molecular-weight polypropylene, polyolefin copolymers, polyolefin wax, microcrystalline wax, paraffin wax and Fischer-Tropsch wax; oxides of aliphatic hydrocarbons, such as polyethylene oxide wax; block copolymers of these; plant waxes such as candelilla wax, carnauba wax, Japan wax and jojoba wax; animal waxes such as beeswax, lanolin and spermaceti; mineral waxes such as ozokerite, ceresin and petrolatum; waxes consisting primarily of fatty acid esters, such as montanic acid ester wax and castor wax; and those obtained by partially or completely deoxidizing fatty acid esters, such as deoxidized carnauba wax.

The content of the wax is preferably 3.0 mass parts to 15.0 mass part per 100 mass parts of the binder resin.

A charge control agent may also be used to stabilize the charging performance of the toner. Examples of charge control agents include organometallic complexes and chelate compounds. Examples include monoazo metal complexes; acetylacetone metal complexes; and metal complexes or metal salts of aromatic hydroxycarboxylic acids or aromatic dicarboxylic acids.

The toner manufacturing method is not particularly limited, and for example a known manufacturing method such as a pulverization method, suspension polymerization method, dissolution suspension method, emulsion aggregation method or dispersion polymerization method may be used.

A pulverization method has the following steps for example:

i) a step of thoroughly mixing the binder resin including the crystalline resin together with a colorant, wax, and other additives and the like as necessary for constituting the toner particle in a mixer such as a Henschel mixer or ball mill;

ii) a step of melt-kneading the resulting mixture using a heat kneading apparatus such as a twin-screw kneading extruder, heating roll, kneader or extruder to blend the resins together while dispersing or melting other materials such as colorants that have been added as necessary;

iii) a step of cooling and solidifying followed by pulverization with a pulverizer; and iv) a step of classifying as necessary.

To control the shape and surface properties of the toner particle, pulverization and classification may also be followed by a surface treatment step in which the mixture is passed through a surface treatment apparatus that applies mechanical impact force continuously.

The surface shape of the toner particle and the adhesive force of the toner can be controlled by controlling the treatment time in this surface treatment step.

The toner particle may be used as is as a toner. Desired external additives may also be mixed with the toner particle as necessary using a mixer such as a Henschel mixer to obtain a toner.

The mixer can be exemplified by the following: FM mixer (Nippon Coke & Engineering. Co., Ltd.); Super Mixer (Kawata Mfg. Co., Ltd.); Ribocone (Okawara Mfg. Co., Ltd.); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The kneader can be exemplified by the following: KRC Kneader (Kurimoto, Ltd.); Buss Ko-Kneader (Buss AG); TEM Extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Mfg., Inc.); Kneadex (Mitsui Mining Co., Ltd.); model MS pressure kneader and Kneader-Ruder (Moriyama Works); and Banbury mixer (Kobe Steel, Ltd.).

The pulverizer can be exemplified by the following: Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The classifier can be exemplified by the following: Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow-Jet (Nittetsu Mining Co., Ltd.); Dispersion Separator (Nippon Pneumatic Mfg. Co., Ltd.); and YM Microcut (Yaskawa & Co., Ltd.).

Examples of surface modification apparatuses include the Faculty (Hosokawa Micron Corporation), Mechano Fusion (Hosokawa Micron Corporation), Nobilta (Hosokawa Micron Corporation), Hybridizer (Nara Machinery), Inomizer (Hosokawa Micron Corporation), Theta Composer (Tokuju Corp.) and Mechanomill (OKADA SEIKO.CO., LTD).

In addition, a screening device as follows may be used to screen the coarse particles:

Ultrasonic (Koeisangyo Co., Ltd.), Rezona Sieve and Gyro-Sifter (Tokuju Corporation), Vibrasonic System (Dalton Corporation), Soniclean (Sintokogio, Ltd.), Turbo Screener (Turbo Kogyo Co., Ltd.), Microsifter (Makino Mfg. Co., Ltd.), and circular vibrating sieves.

The toner may also contain an external additive.

Examples of external additives include fluorine resin powders such as vinylidene fluoride fine powder and polytetrafluoroethylene fine powder; powdered silica such as wet silica and dry silica, powdered titanium oxide and powdered alumina, and treated silica obtained by treating these with silane compounds, titanium coupling compounds or silicone oil; oxides such as zinc oxide and tin oxide; composite oxides such as strontium titanate, barium titanate, calcium titanate, strontium zirconate and calcium zirconate; and carbonate compounds such as calcium carbonate and magnesium carbonate.

Fine powders produced by vapor phase oxidation of silicon halogen compounds, also known as dry silica or fumed silica, are preferred as external additives. An example uses a pyrolysis oxidation reaction in silicon tetrachloride gas in an oxyhydrogen tank, with a basic reaction formula such as the following:

$$SiCl_4+2H_2+O_2 \rightarrow SiO_2+4HCl$$

In this manufacturing step, a composite fine powder of silica with another metal oxide can be obtained by using another metal halogen compound such as aluminum chloride or titanium chloride together with the silicon halogen compound, and this is also considered silica.

Examples of commercial silica fine powders produced by vapor phase oxidation of silicon halogen compounds include Aerosil 130, 200, 300 and 380, TT600, MOX170, MOX80 and COK84 (all from NIPPON AEROSIL CO., LTD), CAB-O-SIL M-5, MS-7, MS-75, HS-5 and EH-5 (all from Cabot Co.), Wacker HDK N 20, V15, N20E, T30 and T40 (all from Wacker-Chemie GmbH), D-C Fine Silica (Dow Corning Co.) and Fransol (Fransil Co.), and these can be used favorably in the present invention.

The content of the external additive is preferably 0.1 mass parts to 3.0 mass parts per 100 mass parts of the toner particle.

Method for Measuring Storage Elastic Modulus of Toner

A DMA8000 (PerkinElmer) is used as the measurement apparatus. A compression fixture (product number: N533-0320) and a heating furnace (product number: N533-0267) are used for measurement.

For the measurement sample, the toner (about 2.0 g) is first pressure molded (compression molded for about 60 seconds at about 10 MPa) in a 25° C. environment with a tablet machine (such as NT-100H from NPa System Co., LTD) into a disk 7.9 mm in diameter and 2.0±0.3 mm thick. The geometry disk is set to the narrow setting, and a clamp support is attached to the geometry disk. A bending clamp and compression insert are passed through the drive shaft terminator, and the sample is set on the compression insert. The fixture is then lowered gently onto this, and the nut is tightened.

Measurement is performed under the following measurement conditions using the measurement wizard.

Heating oven: Standard Air Oven

Measurement type: Frequency scan

Deformation mode: Compression

Frequency Scan Conditions

Start: 0.01 Hz

Cancel: 10 Hz

Point/10:3 (log)

Displacement: 0.05 mm

Start temperature: Tp−30° C.

End temperature: Tp−5° C.

Ramp rate: 5° C./min

Temperature interval: 5° C.

Cross-section: Circular

Dimensions of test piece: Thickness×diameter: value of sample thickness measured with calipers×7.9 mm Isothermal data delay time: 15 secs It is thus possible to obtain G'(Tp−30, 10 Hz), G'(Tp−5, 0.01 Hz) and G'(Tp−5, 10 Hz).

Method for Measuring Storage Modulus of Filler

Measurement is performed after the filler has been separated from the toner. As the method of separation, for example the toner is placed in a cylindrical paper filter (such as product No. 86R (size 28×100 mm) manufactured by Advantec Toyo Kaisha, Ltd.), and set in a Soxhlet extractor. This is then extracted for 16 hours using 200 ml of tetrahydrofuran (THF) as the solvent. Extraction is performed at a reflux speed at which one solvent extraction cycle occurs about every 5 minutes.

After completion of extraction, the cylindrical filter is removed and air dried, and then vacuum dried for 8 hours at 40° C., and the extraction residue is removed. This extraction residue is re-immersed in tetrahydrofuran (THF), and a gel fraction derived from the binder resin is precipitated by centrifugation. The external additive, colorant, magnetic material and the like contained in the toner can also be precipitated in the same way. The supernatant can then be dried to obtain the filler.

Using the separated filler, the storage modulus can be measured by the same methods used to measure the storage modulus of the toner above.

It is thus possible to obtain GF'(Tp−30, 10 Hz) and GF'(Tp−5, 0.01 Hz).

Methods for Measuring Peak Temperature Tp of Endothermic Peak Derived from Crystalline Resin in Toner, Endothermic Quantity of Endothermic Peak Derived from Crystalline Resin in Toner, and Glass Transition Temperature Tg of Resin The Tp, endothermic quantity and Tg are measured using a "Q2000" differential scanning calorimeter (TA Instruments).

The melting points of indium and zinc are used for temperature correction of the device detection part, and the heat of fusion of indium is used for correction of the calorific value.

Specifically, about 5 mg of sample (toner or resin) is weighed exactly and placed in an aluminum plan, and using an empty aluminum pan for reference. measurement is performed at a ramp rate of 10° C./min.

Tp and Endothermic Quantity

Using the toner as the sample, after excluding the peaks of the Tg and relaxation derived from the amorphous resin in the temperature rising step, the endothermic peak temperature seen at the lowest melting point on the DSC curve is given as the Tp. The melting point of the crystalline resin is measured in the same way.

The endothermic quantity is obtained by integrating the endothermic quantity derived from this peak.

Tg of Resin

Using the resin as the sample, a specific heat change is obtained in the temperature range of 40° C. to 100° C. in the temperature rising step. The point of intersection between the differential heat curve and a line intermediate between the baselines before and after the appearance of this specific heat change is given as the glass transition temperature of the resin.

Method for Measuring Peak Molecular Weight

The molecular weight distributions (peak molecular weights Mp) of the crystalline resin and toner are measured as follows by gel permeation chromatography (GPC).

First, the sample is dissolved in toluene over 24 hours at 50° C. The obtained solution is filtered across a "Sample Pretreatment Cartridge" solvent-resistant membrane filter with a pore diameter of 0.2 μm (Tosoh Corporation) to obtain the sample solution. The sample solution is adjusted to a toluene-soluble component concentration of approximately 0.8 mass %. The measurement is performed under the following conditions using this sample solution.

instrument: HLC8120 GPC (detector: RI) (Tosoh Corporation)

columns: 7-column train of Shodex KF-801, 802, 803, 804, 805, 806, and 807 (Showa Denko K.K.)

eluent: toluene flow rate: 1.0 mL/min oven temperature: 40.0° C.

sample injection amount: 0.10 mL

The calibration curve used to determine the molecular weight of the sample is constructed using polystyrene resin standards (product name "TSK Standard Polystyrene F-850, F-450, F-288, F-128, F-80, F-40, F-20, F-10, F-4, F-2, F-1, A-5000, A-2500, A-1000, and A-500", Tosoh Corporation).

Measuring Average Major Axis Diameter of Filler

The average major axis diameter of the filler is measured using an "S-4800" scanning electron microscope (Hitachi, Ltd). The long diameters of 100 random filler particles are measured in a field enlarged to a magnification of 200,000, and the number-average diameter is calculated. The observation magnification is changed as necessary according to the average major axis diameter of the filler.

Method for Confirming Lignin/Cellulose Complex

The presence or absence of the lignin/cellulose complex is confirmed by FT-IR spectrometry using the ATR method. FT-IR spectrometry using ATR method is performed using a Frontier Fourier transform infrared spectrometer (PerkinElmer) equipped with a Universal ATR Sampling Accessory. A diamond AIR crystal is used as the ATR crystal. The other conditions are as follows.

The sample is the filler, and filler that has been separated from the toner can also be used.

Range

Start: 4,000 $cm^{-1}$

End: 600 $cm^{-1}$

Scan number: 8

Resolution: 4.00 $cm^{-1}$

Advanced: $CO_2/H_2O$ corrected

If an absorption band is present in the range of 1240 $cm^{-1}$ to 1220 $cm^{-1}$, the toner particle is judged to contain a lignin/cellulose complex in the present invention.

X-Ray Diffraction Measurement Method

X-ray diffraction measurement is used to determine whether or not the filler is crystalline. Using the filler as the sample, measurement is performed under the following conditions using a horizontal sample type strong X-ray diffractometer (RINT-TTR ii) manufactured by Rigaku Corporation.

Sample Preparation

A sample for X-ray diffraction measurement is prepared using a dedicated sample holder by uniformly packing the sample into a hole or groove of the sample packing part, and pressing with a glass plate or the like so that the surface of the sample holder is on the same plane as the sample surface.

Measurement Conditions for X-Ray Diffraction

Tube: Cu

Parallel Beam Optics

Voltage: 50 kV

Current: 300 mA

Initial angle: 15°

Final angle: 35°

Step width: 0.02°

Scanning speed: LOW/min

Divergence slit: Open

Divergence length restriction slit: 10 mm

Scattering slit: Open

Receiving slit: Open

EXAMPLES

The present invention is explained in more detail below using examples, but these examples do not in any way limit the invention. In the formulation below, "parts" are mass parts unless otherwise specified.

Manufacturing Example of Crystalline Resin (A-1)

| | |
|---|---|
| 1,12-dodecanediol | 100.0 mol parts |
| Sebacic acid | 100.0 mol parts |

These monomers and 0.2 parts of dibutyl tin oxide per 100 parts of the monomers were placed in a 10 L four-necked flask equipped with a nitrogen introduction pipe, a dewatering pipe, a stirrer and a thermocouple, and reacted for 4 hours at 180° C. The temperature was then raised to 210° C. at a rate of 1.0° C./hour, and maintained at 210° C. for 8 hours, after which the mixture was reacted for 1 hour at 8.3 kPa to obtain a crystalline resin (A-1).

The resulting crystalline resin (A-1) had a melting point of 81.9° C. and a peak molecular weight (Mp) of 11800. The storage modulus at Tp−30° C., 10 Hz was $3.02\times10^7$ Pa.

Manufacturing Example of Crystalline Resin (A-2)

| | |
|---|---|
| 1,6-hexanediol | 100.0 mol parts |
| 1,12-decanedicarboxylic acid | 100.0 mol parts |

These monomers and 0.2 parts of dibutyl tin oxide per 100 parts of the monomers were placed in a 10 L four-necked flask equipped with a nitrogen introduction pipe, a dewatering pipe, a stirrer and a thermocouple, and reacted for 4 hours at 180° C. The temperature was then raised to 210° C. at a rate of 10° C./hour, and maintained at 210° C. for 8 hours, after which the mixture was reacted for 1 hour at 8.3 kPa to obtain a crystalline resin (A-2).

The resulting crystalline resin (A-2) had a melting point of 66.5° C. and an Mp of 14600. The storage modulus at Tp−30° C., 10 Hz was $3.25\times10^7$ Pa.

Manufacturing Example of Crystalline Resin (A-3)

100.0 parts of the crystalline resin (A-1), 365.0 parts of styrene, 4.8 parts of copper bromide (I) and 11 parts of pentamethyl diethylene triamine were added to a reactor equipped with a stirrer, a thermometer and a nitrogen introduction pipe. After addition, a polymerization reaction was performed at 110° C. under stirring. The reaction was stopped once the desired molecular weight was reached. This was re-precipitated with 250.0 parts of methanol, filtered, and purified to remove unreacted styrene and catalyst.

This was then dried in a vacuum drier set to 50° C. to obtain a crystalline resin (A-3). The resulting crystalline resin (A-3) had a melting point of 78.3° C. and a Mp of 24500. The storage modulus at Tp−30° C., 10 Hz was $3.81\times10^7$ Pa.

Manufacturing Example of Crystalline Resin (A-4)

| | |
|---|---|
| 1,6-hexanediol | 90.0 mol parts |
| Sebacic acid | 100.0 mol parts |

These monomers and 0.2 parts of dibutyl tin oxide per 100 parts of the monomers were placed in a 10 L four-necked flask equipped with a nitrogen introduction pipe, a dewatering pipe, a stirrer and a thermocouple, and reacted for 4 hours at 180° C. The temperature was then raised to 210° C. at a rate of 10° C./hour, and maintained at 210° C. for 8 hours, after which the mixture was reacted for 1 hour at 8.3 kPa to obtain a crystalline resin (A-0).

The resulting crystalline resin (A-0) was then loaded into a reactor equipped with a stirrer, a thermometer, and a nitrogen introduction pipe. 10.0 mol parts of hexamethylene diisocyanate (HDI) were added as an isocyanate component, and tetrahydrofuran (THF) was added so that the concentration of the crystalline resin (A-0) and HDI was 50 mass %. This was heated to 50° C., and a urethane reaction was performed for 10 hours. The THF solvent was distilled off to obtain a crystalline resin (A-4).

The resulting crystalline resin (A-4) had a melting point of 63.2° C. and a Mp of 50000. The storage modulus at Tp−30° C., 10 Hz was $3.78\times10^7$ Pa.

Manufacturing Example of Crystalline Resin (A-5)

500 parts of toluene were loaded into a reactor equipped with a dripping funnel, and 350 parts of toluene, 120 parts of behenyl acrylate (Blemmer VA, NOF Corp.), 20 parts of 2-ethylhexyl acrylate, 10 parts of methacrylic acid, and 7.5 parts of azobisisobutyronitrile were loaded into a separate glass beaker, and shaken and mixed at 20° C. to prepare a monomer solution which was then loaded into the dripping funnel. The vapor phase of the reactor was purged with nitrogen, after which the monomer solution was dripped in at 80° C. in a sealed state over the course of 2 hours, and after completion of dripping this was cured at 85° C. for 2 hours, and the toluene was removed for 3 hours at 130° C. under reduced pressure to obtain a crystalline resin (A-5).

The resulting crystalline resin (A-5) had a melting point of 58.9° C. and a Mp of 54000. The storage modulus at Tp−30° C., 10 Hz was $2.67\times10^7$ Pa.

Manufacturing Example of Filler (B-1)

Superheated steam-treated bamboo powder (Bamboo Techno) was pulverized with a T-250 mechanical pulverizer (manufactured by Turbo Kogyo), and the resulting finely pulverized powder was classified with a multi-division classifier using the Coanda effect to prepare a filler (B-1). The resulting filler (B-1) had an average major axis diameter of 1.4 μm as measured with a scanning electron microscope. The filler (B-1) was crystalline as measured by X-ray diffraction.

Manufacturing Example of Filler (B-2)

Cellulose filler (Avicel PH-101, Sigma-Aldrich) was treated with the same equipment used to treat the filler (B-1), to prepare a filler (B-2). The resulting filler (B-2) had an average major axis diameter of 1.1 μm as measured with a scanning electron microscope. The filler (B-2) was crystalline as measured by X-ray diffraction.

Manufacturing Example of Filler (B-3)

Lignin (dealkalized lignin, Tokyo Chemical Industry) was treated with the same equipment used to treat the filler (B-1) to prepare a filler (B-3). The resulting tiller (B-3) had an average major axis diameter of 1.8 μm as measured with a scanning electron microscope. The filler (B-3) was crystalline as measured by X-ray diffraction.

Manufacturing Example of Filler (B-4)

Stearic acid-treated calcium carbonate (FilmLink 100, manufactured by IMERYS.) was used. The resulting filler (B-4) had an average major axis diameter of 0.7 μm as measured with a scanning electron microscope. The filler (B-4) was not crystalline as measured by X-ray diffraction.

Manufacturing Example of Binder Resin (C-1)

| | |
|---|---|
| Bisphenol A ethylene oxide (2.2 mol adduct): | 100.0 mol parts |
| Terephthalic acid: | 65.0 mol parts |
| Trimellitic anhydride: | 25.0 mol parts |
| Acrylic acid: | 10.0 mol parts |

80 parts of a mixture of these polyester monomers were loaded into a four-necked flask, a decompressor, moisture separator, nitrogen gas introduction unit, temperature measurement unit and stirrer were attached, and the mixture was stirred at 160° C. in a nitrogen atmosphere. 20 parts of vinyl monomers for constituting the StAc part (90.0 mol parts styrene and 10.0 mol parts 2-ethylhexyl acrylate) and 1 part of benzoyl peroxide as a polymerization initiator were dripped in through a dripping funnel over the course of 4 hours, and reacted for 5 hours at 160° C.

The temperature was then raised to 230° C., 0.2 parts of dibutyl tin oxide were added per 100 parts of the polyester monomer components, and a polycondensation reaction was performed for 6 hours. After completion of the reaction this was removed from the container, cooled, and pulverized to obtain a binder resin (C-1). The resulting binder resin (C-1) had a Tg of 63.1° C.

Manufacturing Example of Binder Resin (C-2)

| | |
|---|---|
| Bisphenol A ethylene oxide (2.2 mol adduct): | 37.0 mol parts |
| Bisphenol A propylene oxide (2.2 mol adduct): | 67.0 mol parts |
| Terephthalic acid: | 77.0 mol parts |

These polyester monomer were loaded into an autoclave together with an esterification catalyst (dibutyl tin oxide), a reflux cooler, moisture separator, N2 gas introduction pipe, thermometer and stirrer were attached, and a polycondensation reaction was performed at 230° C. while N. 2 gas was introduced into the autoclave. After completion of the reaction, the polyester resin was removed from the autoclave, cooled, and pulverized to obtain a binder resin (C-2). The resulting binder resin (C-2) had a Tg of 61.4° C.

Manufacturing Example of Binder Resin (C-3)

800 parts of ion-exchanged water were added to a container having a stirring device capable of heating and cooling, and heated to 60° C. 200 parts of methyl cellulose (SM04, Shin-Etsu Chemical Co., Ltd) were added to the container, and stirred for 15 minutes. The resulting aqueous dispersion was cooled to 10° C., and stirred for 30 minutes to obtain a transparent aqueous methyl cellulose solution.

The resulting aqueous methyl cellulose solution was heated again to 37° C., 0.5 parts of cellulase (AP3, manufactured by Amano Pharmaceutical Co., Ltd.) were added, and the mixture was stirred for 15 minutes and then heated to 98° C. and stirred for 60 minutes to deactivate the cellulase. This was cooled and removed from the container, and freeze dried to obtain a cellulose derivative.

| | |
|---|---|
| Bisphenol A ethylene oxide (2.2 mol adduct): | 65.0 mol parts |
| Ethylene glycol: | 15.0 mol parts |
| Cellulose derivative: | 20.0 mol parts |
| Terephthalic acid: | 86.0 mol parts |

These polyester monomers were loaded into an autoclave together with an esterification catalyst (dibutyl tin oxide), a reflux cooler, moisture separator, N2 gas introduction pipe, thermometer and stirrer were attached, and a polycondensation reaction was performed at 230° C. while $N_2$ gas was introduced into the autoclave. After completion of the reaction, the polyester resin was removed from the autoclave, cooled, and pulverized to obtain a binder resin (C-3). The resulting binder resin (C-3) had a Tg of 62.5° C.

Manufacturing Example of Toner 1

| | |
|---|---|
| Crystalline resin (A-1) | 100.0 parts |
| Filler (B-1) | 30.0 parts |
| Magnetic iron oxide particle (number-average particle diameter = 0.20 μm, Hc = 11.5 kA/m, σs = 88 $Am^2/kg$, σr = 14 $Am^2/kg$) | 95.0 parts |
| Charge control agent (T-77, Hodogaya Chemical Co., Ltd) | 2.0 parts |

These materials were pre-mixed in an FM mixer (Nippon Coke & Engineering Co., Ltd), and then melt kneaded with a twin-screw kneading extruder (PCM-30, manufactured by Ikegai).

The resulting kneaded material was cooled, coarsely pulverized with a hammer mill, and then pulverized with a mechanical pulverizer (T-250, manufactured by Turbo Kogyo), and the resulting finely pulverized powder was classified with a multi-division classifier using the Coanda effect to obtain a negatively charged toner particle with a weight-average particle diameter (D4) of 8.0 μm.

1.2 parts of a hydrophobic silica fine particle (BET specific surface area 150 $m^2/g$, obtained by hydrophobically treating 100 parts of a silica fine particle with 30 parts of hexamethyl disilazane (HMDS) and 10 parts of dimethyl silicone oil) were externally added to 100 parts of the toner particle and mixed with an FM mixer (Nippon Coke & Engineering Co., Ltd FM-75), and then sieved with a 150 micron mesh to obtain a toner 1. The physical properties of the resulting Toner 1 are shown in Table 2.

Manufacturing Examples of Toners 2 to 20

Toners 2 to 20 were obtained in the same way as the toner 1 except that the types and amounts of the crystalline resin, filler, binder resin, magnetic material, colorant (C.I. pigment blue 15:3) and WAX (Fischer-Tropsch wax FNP0090, Nippon Seiro) were changed as shown in Table 1. The physical properties of the resulting Toners 2 to 20 are shown in Table 2.

The ester compound of dipentaerythritol and palmitic acid used in crystalline resin A has a peak molecular weight of Mp 1500.

TABLE 1

| Toner | Crystalline resin A | | Filler B | | Binder resin C | | Magnetic terial | Colorant | WAX |
|---|---|---|---|---|---|---|---|---|---|
| No. | Type | Parts | No. | Parts | No. | Parts | Parts | Parts | Parts |
| 1 | A-1 | 100 | B-1 | 30 | — | — | 95 | — | — |
| 2 | A-3 | 100 | B-1 | 30 | — | — | 95 | — | — |
| 3 | A-4 | 100 | B-1 | 30 | — | — | 95 | — | — |
| 4 | A-4 | 100 | B-2 | 30 | — | — | 95 | — | — |
| 5 | A-5 | 100 | B-1 | 30 | — | — | 95 | — | — |
| 6 | Ester compound of dipentaerythritol and palmitic acid | 100 | B-1 | 30 | — | — | 95 | — | — |
| 7 | A-2 | 40 | B-1 | 5 | C-1 | 60 | — | 10 | — |
| 8 | A-2 | 30 | B-1 | 5 | C-1 | 70 | — | 10 | — |
| 9 | A-3 | 100 | B-1 | 0.5 | — | — | — | 10 | — |
| 10 | A-3 | 100 | B-1 | 100 | — | — | — | 10 | — |
| 11 | A-4 | 100 | B-1 | 5 | — | — | — | 10 | 10 |
| 12 | A-3 | 100 | B-3 | 5 | — | — | — | 10 | — |

TABLE 1-continued

| Toner | Crystalline resin A | | Filler B | | Binder resin C | | Magnetic terial | Colorant | WAX |
|---|---|---|---|---|---|---|---|---|---|
| No. | Type | Parts | No. | Parts | No. | Parts | Parts | Parts | Parts |
| 13 | A-3 | 40 | B-3 | 5 | C-1 | 60 | — | 10 | — |
| 14 | A-2 | 70 | — | — | C-3 | 30 | — | 10 | — |
| 15 | A-4 | 70 | — | — | C-3 | 30 | — | 10 | — |
| 16 | A-3 | 100 | — | — | — | — | 95 | — | — |
| 17 | A-4 | 100 | B-4 | 30 | — | — | — | 10 | — |
| 18 | A-2 | 25 | B-1 | 5 | C-1 | 75 | — | 10 | — |
| 19 | A-2 | 30 | — | — | C-1 | 40 | — | 10 | — |
| | | | | | C-2 | 30 | | | |
| 20 | FNP0090 | 100 | B-1 | 5 | — | | — | 10 | — |

TABLE 2

| Toner No. | Mp | Tp (° C.) | G'(Tp-30, 10 Hz) (Pa) | G'(Tp-5, 10 Hz) (Pa) | G'(Tp-5, 0.01 Hz) (Pa) | A | B | GF'(Tp-30, 10 Hz) (Pa) | GF'(Tp-5, 0.01 Hz) (Pa) | F | Endothermic quantity (J/g) |
|---|---|---|---|---|---|---|---|---|---|---|---|
| 1 | 11800 | 81.3 | 3.28E+07 | 3.73E+07 | 2.85E+07 | 1.15 | 1.31 | 3.01E+07 | 2.62E+07 | 1.15 | 67 |
| 2 | 24510 | 78.3 | 3.55E+07 | 4.09E+07 | 3.01E+07 | 1.18 | 1.36 | 2.99E+07 | 2.65E+07 | 1.13 | 41 |
| 3 | 50100 | 63.2 | 4.08E+07 | 4.72E+07 | 3.52E+07 | 1.16 | 1.34 | 2.87E+07 | 2.96E+07 | 0.97 | 48 |
| 4 | 50020 | 63.1 | 4.00E+07 | 4.70E+07 | 3.48E+07 | 1.15 | 1.35 | 2.86E+07 | 3.01E+07 | 0.95 | 48 |
| 5 | 54020 | 57.6 | 2.61E+07 | 3.67E+07 | 1.88E+07 | 1.39 | 1.95 | 2.83E+07 | 3.04E+07 | 0.93 | 24 |
| 6 | 1560 | 72.3 | 1.52E+07 | 2.18E+07 | 1.10E+07 | 1.38 | 1.98 | 2.82E+07 | 2.59E+07 | 1.09 | 61 |
| 7 | 14300 | 66.5 | 2.60E+07 | 4.17E+07 | 2.13E+07 | 1.22 | 1.96 | 2.88E+07 | 2.72E+07 | 1.06 | 20 |
| 8 | 14600 | 66.3 | 2.41E+07 | 4.38E+07 | 2.01E+07 | 1.20 | 2.18 | 2.90E+07 | 2.74E+07 | 1.06 | 15 |
| 9 | 24480 | 80.7 | 3.55E+07 | 4.10E+07 | 2.93E+07 | 1.21 | 1.40 | 2.92E+07 | 2.61E+07 | 1.12 | 63 |
| 10 | 24490 | 80.8 | 4.72E+07 | 4.96E+07 | 4.03E+07 | 1.17 | 1.23 | 2.91E+07 | 2.60E+07 | 1.12 | 32 |
| 11 | 50030 | 63.1 | 4.03E+07 | 4.50E+07 | 3.33E+07 | 1.21 | 1.35 | 2.96E+07 | 2.51E+07 | 1.18 | 71 |
| 12 | 24550 | 80.4 | 3.83E+07 | 3.92E+07 | 2.86E+07 | 1.34 | 1.37 | 2.95E+07 | 2.63E+07 | 1.12 | 61 |
| 13 | 24540 | 80.2 | 2.49E+07 | 3.93E+07 | 1.83E+07 | 1.36 | 2.15 | 2.92E+07 | 2.61E+07 | 1.12 | 22 |
| 14 | 50000 | 62.9 | 2.17E+07 | 3.37E+07 | 1.66E+07 | 1.31 | 2.03 | 2.58E+07 | 2.00E+07 | 1.29 | 44 |
| 15 | 14500 | 64.8 | 1.97E+07 | 2.95E+07 | 1.42E+07 | 1.39 | 2.08 | 2.46E+07 | 1.81E+07 | 1.36 | 52 |
| 16 | 24530 | 80.6 | 2.95E+07 | 2.85E+07 | 1.62E+07 | 1.82 | 1.76 | — | — | — | 66 |
| 17 | 49990 | 63.1 | 7.00E+07 | 6.76E+07 | 4.83E+07 | 1.45 | 1.40 | 4.34E+07 | 4.21E+07 | 1.03 | 80 |
| 18 | 14550 | 66.1 | 3.01E+07 | 6.08E+07 | 2.69E+07 | 1.12 | 2.26 | 2.82E+07 | 2.66E+07 | 1.06 | 13 |
| 19 | 14580 | 65.9 | 3.25E+07 | 6.13E+07 | 2.75E+07 | 1.18 | 2.23 | — | — | — | 14 |
| 20 | 820 | 89.5 | 8.67E+07 | 1.23E+08 | 2.09E+07 | 4.15 | 5.89 | 2.94E+07 | 2.60E+07 | 1.13 | 136 |

In the tables, the notation "3.28E 07" means $3.28\times10^7$. A represents the value of G'(Tp−30, 10 Hz)/G(Tp−5, 0.01 Hz), B represents the value of G(Tp−5, 10 Hz)/G(Tp−5, 0.01 Hz) and F represents the value of GF(Tp−30, 10 Hz)/GF'(Tp−5, 0.01 Hz).

The storage elastic moduli of the fillers of toners 14 and 15 are values derived from the resin C-3.

Example 1

The toner 1 was evaluated as follows. The evaluation results are shown in Table 3.

Evaluating Low-Temperature Fixability of Toner

An HP LaserJet Enterprise M609dn was used with the process speed modified to 410 mm/sec.

The low-temperature fixability of the toner was evaluated by a rubbing test. The fixing unit was removed from the evaluation apparatus, modified so that the temperature could be set at will and the process speed was 410 mm/sec, and used as an external fixing unit.

In a low-temperature, low humidity environment (15° C., 10% RH), an unfixed image with a toner laid-on level per unit area of 0.50 mg/cm$^2$ when a magnetic material was included and 0.35 mg/cm$^2$ without a magnetic material was passed through the above fixing unit, which had been adjusted to a set temperature. "PB PAPER" (Canon Marketing Japan Inc., basis weight 66 g/m$^2$, letter size) was used as the evaluation paper.

The resulting fixed image was rubbed with Silbon paper under a load of 4.9 kPa (50 g/cm$^2$), and the temperature at which the density reduction after testing was not more than 10% was given as the fixing temperature. The image density was measured using a Macbeth densitometer (MacBeth & Co.), which is a reflection densitometer. A rank of C or better is considered good.

A: Fixing temperature less than 120° C.

B: Fixing temperature at least 120° C. and less than 130° C.

C: Fixing temperature at least 130° C. and less than 140° C.

D: Fixing temperature at least 140° C. and less than 150° C.

E: Fixing temperature at least 150° C.

Evaluation of Toner Fixing Irregularity

An HP LaserJet Enterprise M609dn was used with the process speed modified to 410 mm/sec.

100 sheets of an image having, a patch image with a reflection density of 0.9 were printed continuously in a low-temperature, low-humidity environment (15° C., 10% RH).

Fixing irregularity was then evaluated based on the difference between the maximum and minimum values for gloss in the 100th sheet of the patch image. The gloss values were measured using an IG-310 Handy Gloss Checker (manufactured by Horiba, Ltd.). Hammermill Laser Print (basis weight 105 g/m$^2$, letter size) was used as the evaluation paper. A rank of C or better is considered good.

A: Difference of less than 1.0 between maximum and minimum gloss values

B: Difference of at least 1.0 and less than 1.5 between maximum and minimum gloss values C: Difference of at least 1.5 and less than 2.0 between maximum and minimum gloss values D: Difference of at least 2.0 and less than 2.5 between maximum and minimum gloss values E: Difference of at least 2.5 between maximum and minimum gloss values Examples 2 to 15

The toners 2 to 15 were evaluated as in the Example 1. The evaluation results are shown in Table 3.

Comparative Examples 1 to 5

The toners 16 to 20 were evaluated as in the Example 1. The evaluation results are shown in Table 3.

TABLE 3

| | | Low-temperature fixability | Fixing irregularity |
|---|---|---|---|
| Example 1 | Toner 1 | A(105° C.) | A(0.8) |
| Example 2 | Toner 2 | A(104° C.) | A(0.8) |
| Example 3 | Toner 3 | A(101° C.) | A(0.9) |
| Example 4 | Toner 4 | A(114° C.) | A(0.9) |
| Example 5 | Toner 5 | B(126° C.) | C(1.8) |
| Example 6 | Toner 6 | B(121° C.) | C(1.7) |
| Example 7 | Toner 7 | B(125° C.) | A(0.7) |
| Example 8 | Toner 8 | C(131° C.) | A(0.5) |
| Example 9 | Toner 9 | A(102° C.) | A(0.6) |
| Example 10 | Toner 10 | B(120° C.) | A(0.6) |
| Example 11 | Toner 11 | A(101° C.) | A(0.8) |
| Example 12 | Toner 12 | A(113° C.) | B(1.4) |
| Example 13 | Toner 13 | B(129° C.) | C(1.7) |
| Example 14 | Toner 14 | B(126° C.) | B(1.3) |
| Example 15 | Toner 15 | C(130° C.) | C(1.9) |
| Comparative Example 1 | Toner 16 | A(114° C.) | E(2.8) |
| Comparative Example 2 | Toner 17 | A(112° C.) | D(2.4) |
| Comparative Example 3 | Toner 18 | D(149° C.) | A(0.7) |
| Comparative Example 4 | Toner 19 | D(144° C.) | B(1.2) |
| Comparative Example 5 | Toner 20 | E(152° C.) | E(3.6) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-042839, filed Mar. 8, 2019, which is hereby incorporated by reference herein in its entirety.

What is claimed is:

1. A toner comprising:

a toner particle containing a binder resin, wherein the binder resin contains a crystalline resin, an endothermic peak derived from the crystalline resin exists in a temperature-endothermic quantity curve obtained by differential scanning calorimetry of the toner, and in viscoelasticity measurement of the toner with Tp being a peak temperature of the endothermic peak derived from the crystalline resin, given G'(Tp−5, 0.01 Hz) as a storage modulus at a temperature of Tp−5° C. and a frequency of 0.01 Hz, G'(Tp−5, 10 Hz) as a storage modulus at a temperature of Tp−5° C. and a frequency of 10 Hz, and G'(Tp−30, 10 Hz) as a storage modulus at a temperature of Tp−30° C. and a frequency of 10 Hz, formulae below are satisfied:

$$G'(Tp-30,10\text{ Hz})/G'(Tp-5,0.01\text{ Hz})\leq 1.40$$

$$G'(Tp-5,10\text{ Hz})/G'(Tp-5,0.01\text{ Hz})\leq 2.20.$$

2. The toner according to claim 1, wherein the toner contains a filler, and in viscoelasticity measurement of the filler, given GF'(Tp−30, 10 Hz) as a storage modulus at a temperature of Tp−30° C. and a frequency of 10 Hz and GF'(Tp−5, 0.01 Hz) as a storage modulus at a temperature of Tp−5° C. and a frequency of 0.01 Hz, a formula below is satisfied:

$$0.70\leq GF'(Tp-30,10\text{ Hz})/GF'(Tp-5,0.01\text{ Hz})\leq 1.30.$$

3. The toner according to claim 2, wherein the filler has crystallinity.

4. The toner according to claim 2, wherein the filler has a cellulose structure.

5. The toner according to claim 2, wherein the filler contains a lignin/cellulose complex.

6. The toner according to claim 1, wherein an endothermic quantity of the endothermic peak derived from the crystalline resin in the toner is from 20 J/g to 200 J/g.

7. The toner according to claim 1, wherein the crystalline resin includes a crystalline polyester resin.

* * * * *